US010030459B2

(12) United States Patent
Stokes et al.

(10) Patent No.: US 10,030,459 B2
(45) Date of Patent: Jul. 24, 2018

(54) THRU-CASING MILLING

(71) Applicant: Smith International, Inc., Houston, TX (US)

(72) Inventors: David A. Stokes, The Woodlands, TX (US); Timothy M. O'Rourke, Houston, TX (US); Nathan E. Fuller, Spring, TX (US)

(73) Assignee: SMITH INTERNATIONAL, INC., Houston, TX (US)

( * ) Notice: Subject to any disclaimer, the term of this patent is extended or adjusted under 35 U.S.C. 154(b) by 366 days.

(21) Appl. No.: 14/789,001

(22) Filed: Jul. 1, 2015

(65) Prior Publication Data

US 2016/0010413 A1 Jan. 14, 2016

Related U.S. Application Data

(60) Provisional application No. 62/021,831, filed on Jul. 8, 2014.

(51) Int. Cl.
*E21B 29/00* (2006.01)

(52) U.S. Cl.
CPC ..... *E21B 29/005* (2013.01); *E21B 29/002* (2013.01)

(58) Field of Classification Search
CPC ..... E21B 29/00; E21B 29/002; E21B 29/005
USPC ..... 166/297, 298, 55.6, 55.7, 55.8
See application file for complete search history.

(56) References Cited

U.S. PATENT DOCUMENTS 2,353,284 A * 7/1944 Barrett ..... B23B 5/16 166/55.8
3,295,604 A * 1/1967 Cordary ..... E21B 29/005 166/55.8
3,376,927 A * 4/1968 Brown ..... E21B 29/12 166/361
4,887,668 A * 12/1989 Lynde ..... B23B 5/16 166/55.8
5,150,755 A * 9/1992 Cassel ..... B23B 5/16 166/297
5,201,817 A * 4/1993 Hailey ..... E21B 10/322 166/55.8
5,265,675 A * 11/1993 Hearn ..... E21B 10/322 166/297
5,791,409 A * 8/1998 Flanders ..... E21B 29/005 166/298
6,679,328 B2 * 1/2004 Davis ..... E21B 10/322 166/298
7,909,100 B2 * 3/2011 Bryant, Jr. ..... E21B 29/005 166/298
8,540,035 B2 9/2013 Xu et al.
8,555,955 B2 10/2013 Davis
(Continued)

FOREIGN PATENT DOCUMENTS

WO 2010054407 A1 5/2010
WO 2011135541 A2 11/2011
(Continued)

*Primary Examiner* — Kenneth L Thompson

(57) ABSTRACT

A section milling device may include a plurality of rotatable arms that each include one or more cutting members. The rotatable arms may be rotated between a retracted position and an extended position. When rotated to the extended position, the rotatable arms may be locked or substantially limited in their movement by one or more hydraulic pistons. The rotatable arms may be held at a predetermined angle during milling operations.

17 Claims, 6 Drawing Sheets

(56) References Cited

U.S. PATENT DOCUMENTS

| | | | |
|---|---|---|---|
| 8,794,354 | B2 | 8/2014 | Xu et al. |
| 9,022,117 | B2 | 5/2015 | Segura et al. |
| 9,097,073 | B2 | 8/2015 | Schmidt et al. |
| 9,187,971 | B2 * | 11/2015 | Hutchinson ..... E21B 29/005 |
| 2009/0308605 | A1 | 12/2009 | McAfee et al. |
| 2013/0168076 | A1 | 7/2013 | Davis |
| 2013/0199785 | A1 | 8/2013 | Hekelaar |
| 2014/0034317 | A1 | 2/2014 | Hekelaar |
| 2014/0332200 | A1 | 11/2014 | Ruttley |
| 2015/0096753 | A1 | 4/2015 | Kulage |
| 2015/0101812 | A1 | 4/2015 | Bansal et al. |
| 2015/0129195 | A1 | 5/2015 | Laird et al. |
| 2015/0211315 | A1 | 7/2015 | Ruttley |
| 2015/0354306 | A1 | 10/2015 | Fuller et al. |

FOREIGN PATENT DOCUMENTS

| | | | |
|---|---|---|---|
| WO | 2013187902 | A1 | 12/2013 |
| WO | 2015009662 | A2 | 1/2015 |
| WO | 2015168575 | A1 | 11/2015 |

* cited by examiner

THRU-CASING MILLING

CROSS-REFERENCE TO RELATED APPLICATIONS

This application claims the benefit of, and priority to, U.S. patent application Ser. No. 62/021,831, filed Jul. 8, 2014, which application is expressly incorporated herein by this reference in its entirety.

BACKGROUND

Wells drilled for the production of oil and gas are commonly finished by cementing one or more metallic casing strings in the borehole. Additional casing strings may be used depending on the surrounding formation and particular properties of the surrounding formation (e.g., formation porosity, formation hardness, flow rate, etc.). For example, a dual casing system may be employed with two concentric metallic casing strings. The two concentric casing strings may be cemented with a layer of cement located in the annular space between the casing strings.

In some circumstances, such as after a well is no longer commercially viable, the well can be abandoned. To satisfy governmental regulations for abandoning a well, one or more permanent barriers may be created inside the well to isolate the well from the surrounding formation. A particular length of the casing string may also be removed prior to filling the well with a cement plug to seal the well. One method of removing a casing string from a well includes the delivery and use of a section mill having multiple blades. The section mill may be coupled to a drill string that is tripped into the well and controlled by a drill rig at the surface.

The blades of the section mill may be in a retracted or inactive state when tripped into the wellbore. The drill string allows placement of the section mill at the desired location in the well, and the blades can be expanded to an active or deployed state through the use of hydraulic fluid provided through the drill string. By rotating the section mill, the expanded blades can remove portions of the casing string and cement in the well.

Where a well has two, concentric casing strings, milling of the dual-casing well can be performed by tripping one section mill into the well to mill the smaller diameter inner casing. That section mill can then be tripped out of the well and a section mill with larger blades can be tripped into the well and located at the same location in the well and for milling the larger diameter outer casing.

SUMMARY

In some embodiments, a device includes a tubular body having an inner surface with an inner diameter and an outer surface with an outer diameter. The tubular body has a plurality of openings extending through the tubular body from the inner surface to the outer surface and a plurality of rotatable arms. Each of the rotatable arms has a cutting member defined by a front face and a back face and each rotatable arm is configured to rotate between a retracted position and an extended position. The retracted position is entirely within the outer surface and the extended position being at least partially outside the outer surface. A cutting surface is located on the front face of the cutting member, and the cutting surface includes at least one cutting insert.

In another embodiment, a device for removing casing material includes a tubular body having an inner surface and an outer surface with a first end and a second end. The device also includes a tool connection located at an end of the tubular body and configured to connect to a drill string or a downhole tool. The tubular body has a plurality of openings extending through the tubular body from the inner surface to the outer surface and a plurality of rotatable arms. Each of the rotatable arms has a cutting member defined by a front face and a back face and each rotatable arm configured to rotated between a retracted position and an extended position. The retracted position is entirely within the outer surface and the extended position being at least partially outside the outer surface. A cutting surface is located on the front face of the cutting member, and the cutting surface includes at least one cutting insert, such as at least one section mill insert in one configuration. The device also includes one or more expandable stabilizer members associated with the tubular body. The one or more expandable stabilizer members are configured to apply a force radially outward against the casing material.

In addition, the above identified devices can include a first fluid chamber and a second fluid chamber. The first fluid chamber is associated with a first piston and the second fluid chamber is associated with a second piston. The devices can also include a stop block associated with the second fluid chamber and having an engaged position and a disengaged position. The stop block has a sloped surface configured to engage with the plurality of rotatable arms in the extended position when in the engaged position.

A method of removing casing material in a downhole environment includes tripping a section milling device having a body diameter into a downhole environment having a casing material, expanding an expandable stabilizer member, and moving a plurality of rotatable arms to an extended position such that the rotatable arms are adjacent the casing material and define a cutting diameter greater than 1.2 times the body diameter. The method also includes rotating at least part of the section milling device such that the rotatable arms move relative to the casing material and cutting the casing material using a cutting surface on the rotatable arms.

This summary is provided to introduce a selection of concepts that are further described below in the detailed description. This summary is not intended to identify key or essential features of the claimed subject matter, nor is it intended to be used as an aid in limiting the scope of the claimed subject matter.

BRIEF DESCRIPTION OF THE DRAWINGS

In order to describe the manner in which embodiments of the present disclosure may be used, a more particular description will be rendered by reference to specific embodiments as illustrated in the appended drawings. While some of the drawings are schematic representations of systems, assemblies, features, methods, or the like, at least some of the drawings may be drawn to scale. Understanding that these drawings depict example embodiments of the disclosure and are not therefore to be considered to be limiting of the scope of the present disclosure or to scale for each embodiment contemplated herein, the embodiments will be described and explained with additional specificity and detail through the use of the accompanying drawings in which.

DETAILED DESCRIPTION

One or more specific embodiments of the present disclosure will be described below. These described embodiments are examples of the presently disclosed techniques. Additionally, in an effort to provide a concise description of these embodiments, some features of an actual implementation may be described in the specification. It should be appreciated that in the development of any such actual implementation, as in any engineering or design project, numerous implementation-specific decisions will be made to achieve the developers' specific goals, such as compliance with system-related and business-related constraints, which may vary from one implementation to another. It should further be appreciated that such a development effort might be complex and time consuming, but would nevertheless be a routine undertaking of design, fabrication, and manufacture for those of ordinary skill having the benefit of this disclosure.

Embodiments of this disclosure generally relate to devices, systems, and methods for milling. Embodiments of the present disclosure further relate to device, systems, and methods for removing casing material from a wellbore. More particularly, embodiments disclosed herein may relate to milling devices, systems, assemblies, and methods for milling a portion of a casing string in a downhole environment. Even more particularly, embodiments disclosed herein may relate to devices, systems, and methods for milling casing material within a dual-casing wellbore or within a downhole environment in which the portion of casing string to be milled has a larger diameter than an upper portion of the casing string through which the section milling device may first be tripped.

A section milling device may achieve a high cutting diameter to body diameter ratio by employing rotatable arms having cutting surfaces. The rotatable arms may be connected to a body and rotated outwardly from the body through a slot or other opening in an outer surface of the body. The rotatable arms can, therefore, be entirely within a periphery of an outer surface of the body when in a retracted position and rotate at least partially outside the outer surface of the body when in an expanded or extended position. When in an extended or deployed orientation extending outside the outer surface, the rotatable arms may be locked in the extended position by opposing locking interfaces on upper and lower surfaces of the rotatable arms. The opposing locking interfaces may transfer torsional loads placed on the rotatable arms to the locking interfaces, and hence to the body of the section milling device, during operation. The transfer of torsional loads to the body during operation may allow the rotatable arms to withstand high torsional loads before failure. In other embodiments, the rotatable arms may be replaced by translating arms that expand radially outward by translating axially (e.g., along an angled ridge or surface)

Figure 1:
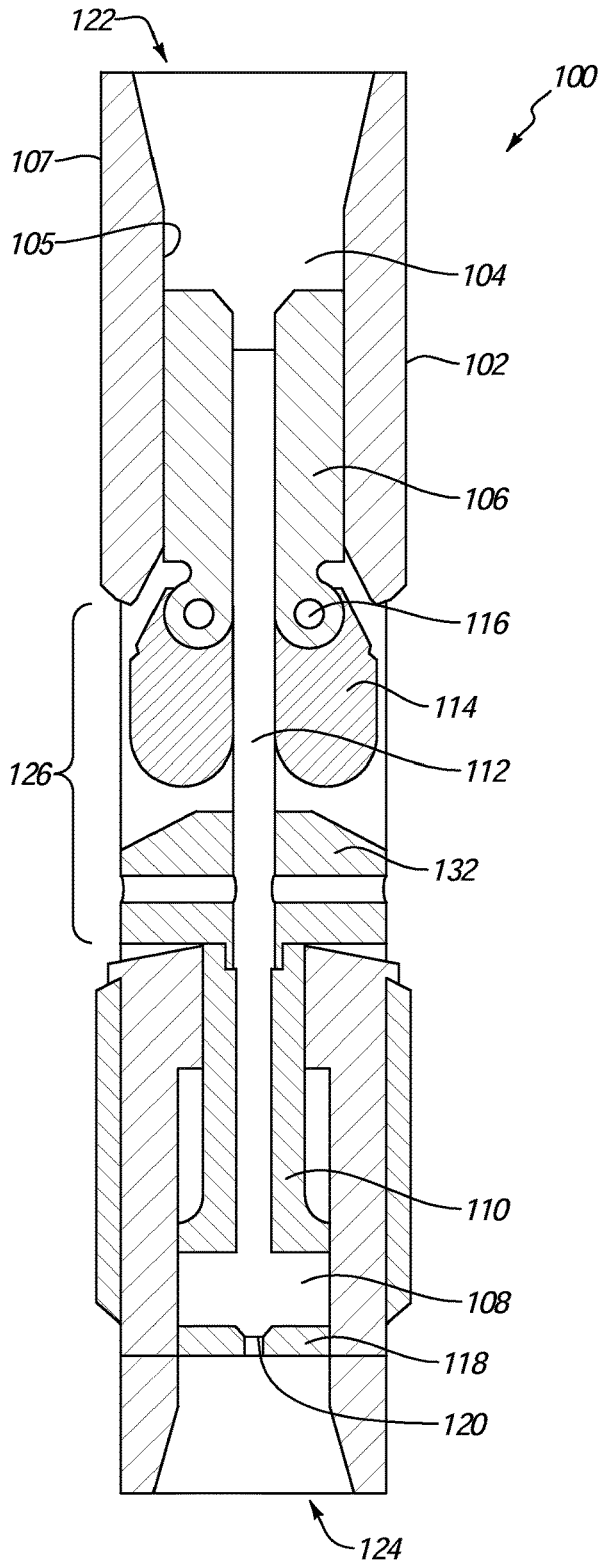
FIG. 1 is a cross-sectional side view of a section milling device having rotatable arms in a retracted position, according to some embodiments of the present disclosure.

FIG. 1 depicts a section milling device 100 according to some embodiments of the present disclosure. The section milling device 100 may include a body 102 with an inner surface 105 having an inner diameter that partially defines a first fluid chamber 104 and a second fluid chamber 108. These fluid chambers 104 and 108 may be operatively associated, respectively, with a first piston 106 and a second piston 110 which aid with movement of rotatable arms 114. The first fluid chamber 104 and second fluid chamber 108 can be connected and in fluid communication via a fluid channel 112. For example, the first fluid chamber 104 can exhibit a similar or identical fluid pressure as the second fluid chamber 108 when a fluid is introduced to the section milling device 100 (as depicted in relation to FIG. 2).

In some embodiments, the body 102 may be a tubular body and the lateral cross-section of the body may be substantially circular. In other embodiments, the body 102 may have a lateral cross-section that is another shape suitable for delivery into a wellbore, such as an ellipse, a square, a pentagon, a hexagon, an octagon, another regular polygon, an irregular polygon, or a combination thereof.

As mentioned herein, and as shown in FIG. 1, the section milling device 100 may include a plurality of rotatable arms 114 that have a retracted position. The section milling device 100 may include two, three, four, or more rotatable arms 114. In some embodiments, the rotatable arms 114 may be distributed evenly about the circumference of the section milling device 100. For example, in such embodiments, a section milling device 100 having two rotatable arms 114 may have the two rotatable arms spaced 180° from one another. In another example, a section milling device 100 having three rotatable arms may have the three rotatable arms spaced 120° from one another. The rotatable arms 114 can, however, be unevenly distributed about the circumference. In some embodiments, the angular spacing between unequally spaced rotatable arms may be less than 180°.

The rotatable arms 114 may be rotatably connected to the first piston 106 at a pivot 116. In some embodiments, the pivot 116 may be a hinge or other rotatable connection point. In other embodiments, the pivot 116 may include an axle therethrough to allow rotational movement of the rotatable arm 114 relative to the first piston 106. In yet other embodiments, the pivot 116 may include a flexible connection such that the angle of the rotatable arm 114 may change relative to the first piston 106. Generally, the pivot 116 may be a location about which the rotatable arm 114 may move between the retracted position and an extended or deployed position.

In some embodiments, the rotatable arms 114 may be located between the first fluid chamber 104 and the second fluid chamber 108. The second fluid chamber 108 may include an end plate 118 with a fluid outlet 120 located therein. The fluid outlet 120 may be sized so that fluid passing through the fluid outlet 120 may be selectively obstructed or the flow of fluid from the second fluid chamber 108 is limited. For example, the fluid outlet 120 may be sized such that the fluid outlet 120 alone may generate enough of a pressure differential that the fluid pressure may be modulated by a flowrate of the fluid (e.g., fluid 230 shown in FIG. 2). In another example, the fluid outlet 120 may be tapered to form a seat, such that a ball or other obstruction may be delivered to the fluid outlet 120 and subsequently trapped by the fluid outlet 120. The obstruction (and fluid) may be provided to the section milling device 100 by a first tool connection 122 and may exit through a second tool connection 124. The first and second tool connections 122, 124 may each be configured to allow the section milling device 100 to be incorporated into a drill string or to connect to other tools within a bottomhole assembly.

The obstruction may allow for a fluid pressure to increase within the second fluid chamber 108, the fluid channel 112, and the first fluid chamber 104. The first fluid chamber 104 and second fluid chamber 108 may then apply a force to the first piston 106 and second piston 110, respectively. The force applied to the first piston 106 may move the first piston 106 downward and toward the second piston 110. The force applied to the second piston 110 may move the second piston 110 upward and toward the first piston 106.

The movement of the first piston 106 downward may also move the plurality of rotatable arms 114 and the associated rotatable connection points 116 downward and toward the second piston 110. The movement of the second piston 110 upward may also move a stop block 132 upward and toward the first piston 106 and the rotatable arms 114. Movement of the stop block 132 and rotatable arms 114 towards one another may urge the rotatable arms 114 radially outward.

Figure 2:
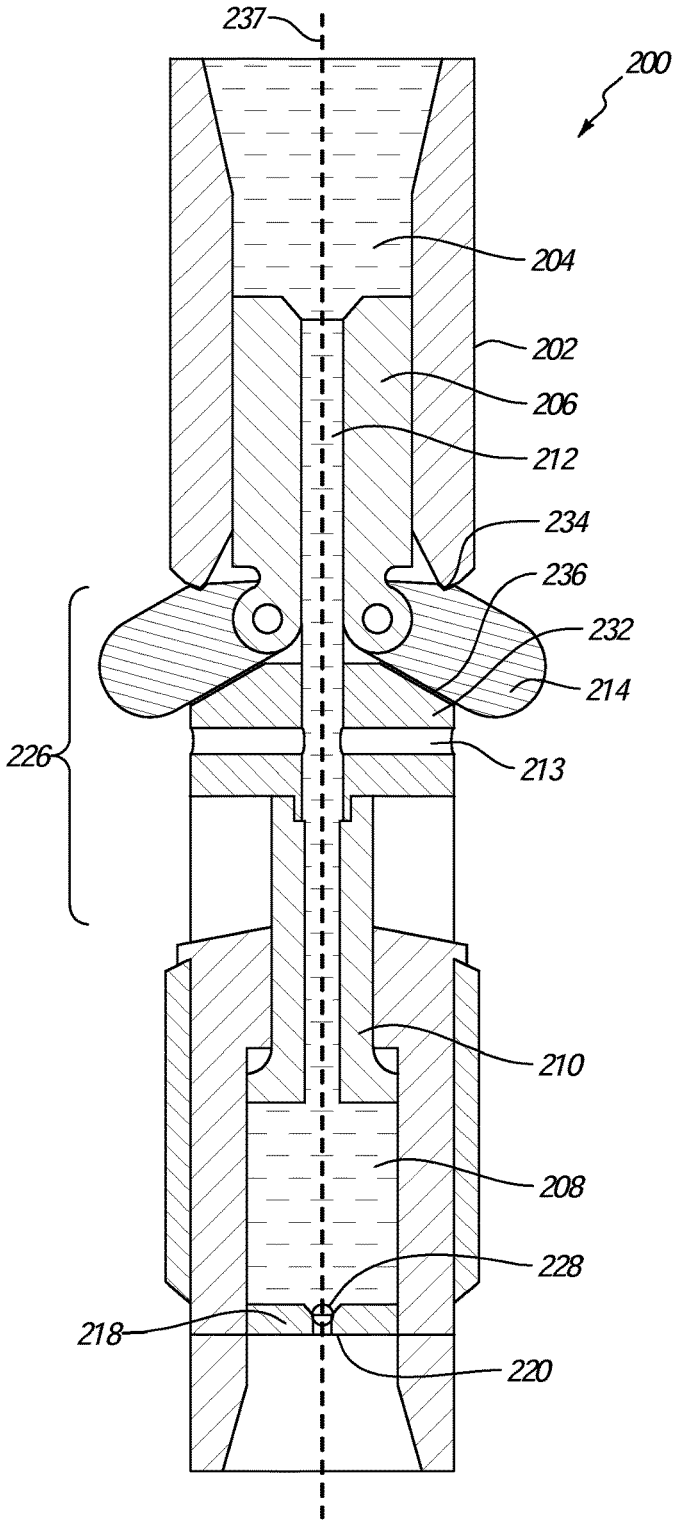
FIG. 2 is a cross-sectional side view of a section milling device having rotatable arms in an extended position, according to some embodiments of the present disclosure.

The section milling device 100 may also include one or more openings 126 that extend from the inner surface 105 of the body 102 through an outer surface 107 that defines an outer diameter. The openings may allow movement of the rotatable arms 114 from a retracted position (as shown in FIG. 1) to an extended position with at least part of the rotatable arms 114 extending radially outward through the openings 126 (as shown in FIG. 2). In some embodiments, the section milling device 100 may be used as an under-reamer but the rotatable arms 114 may be modified to include cutting inserts for section milling (e.g., face milling of casing) as opposed to cutting elements for underreaming. For instance, cutting inserts may coupled to a face of the rotatable arms 114 as opposed to being positioned primarily proximate an outer, radial edge of the rotatable arms 114.

FIG. 2 depicts a section milling device 200 with a plurality of rotatable arms 214 in an extended position. An obstruction, such as a ball 228, may be delivered to the fluid outlet 220 in the end plate 218. A fluid 230 (e.g., a drilling fluid) may then be delivered through a drill string (not shown) to the first fluid chamber 204. The fluid 230 may flow through the fluid channel 212 to the second fluid chamber 208 where the ball 228 obstructs the flow of the fluid 230. The obstructed flow of the fluid 230 out of the fluid outlet 220 may cause the fluid pressure within the first fluid chamber 204 and second fluid chamber 208 to increase. The increased fluid pressure in the first fluid chamber 204 may apply a force to the first piston 206. The increased fluid pressure in the second fluid chamber 208 may apply a force to the second piston 210. As described in relation to FIG. 1, the force applied to the first piston 206 and second piston 210 may cause relative movement thereof. The relative movement of the first piston 206 and second piston 210 toward one another may urge the rotatable arms 214 and the stop block 232 toward one another. The movement of the rotatable arms 214 and the stop block 232 toward one another may urge the rotatable arms 214 radially outward and through the openings 226. The increased fluid pressure in the fluid channel 212 may cause fluid 230 to exit through radial outlets 213 formed in the stop block 232. The fluid 230 exiting through the radial outlets 213 may be used to cool the rotatable arms 214 or to lubricate and assist in mobilizing cuttings during operation of the section milling device 200.

The section milling device 200 may include a mechanical biasing mechanism to bias the movement of the first piston 206 and/or second piston 210. For example, the section milling device 200 may include a spring mechanism acting upon the first piston 206 to counterbalance the weight of the first piston 206 when operated in a vertical position (i.e., operated in a vertical wellbore). In another example, the section milling device 200 may include a spring mechanism acting upon the first piston 206 and/or second piston 210 to assist in disengaging and retracting the rotatable arms 214 when the fluid pressure decreases.

The stop block 232 may engage the rotatable arms 214 when in an engaged position as depicted in FIG. 2. A sloped surface 236 of the stop block 232 may apply a force to each of the rotatable arms 214. The rotatable arms 214 may each experience a counteracting force applied by the body 202 at an engagement feature 234 in each of the rotatable arms 214. The engagement feature 234 may restrict the movement of the rotatable arm 214 relative the body 202 and stop block 232. In at least one non-limiting embodiment, the engagement feature 234 may transfer at least part of a torsional load experienced by the rotatable arm 214 during operation to the body 202, thereby increasing the torsional load the rotatable arms 214 may experience during operation prior to failure.

In some embodiments, the rotatable arms 214 define a cutting diameter. For instance, a radially outermost ends of two or more rotatable arms 214 on opposite sides of the body 202 can define a cutting diameter. Where rotatable arms 214 are not directly opposed, the cutting diameter may be twice the cutting radius (i.e., the distance from a longitudinal axis 237 to the radially outermost end of a rotatable arm 214). The cutting diameter may be larger than a diameter of the body 202. A ratio of the cutting diameter to the body diameter may define a expansion ratio. In some embodiments, the expansion ratio may be between 1.1:1 and 1.9:1. For instance, the expansion ratio may be greater than 1.35:1. In other embodiments, the expansion ratio may 1.4:1. In further embodiments, the expansion ratio may be greater than 1.2:1. In yet other embodiments, the expansion ratio may be between 1.2:1 and 1.75:1. In yet further embodiments, the expansion ratio may be greater than 1.75:1. In at least one embodiment, a section milling device in accordance with embodiments of the present disclosure may substantially reduce or even prevent chatter (i.e., vibration during cutting) when milling with a expansion ratio above 1.2:1. In at least another embodiment, a section milling device in accordance with present disclosure may substantially reduce torsional loads on the rotatable arms 214 when milling with an expansion ratio greater than 1.35:1 and/or an expansion ratio greater than 1.4:1. In at least a further embodiment, a section milling device in accordance with embodiments of the present disclosure may substantially reduce torsional loads on the rotatable arms 214 when milling with an expansion ratio greater than 1.75:1. The expansion ratio may be greater when milling with section milling device 200 in a stabilized application as compared to milling with section milling device 200 in an unstabilized application (as described in relation to FIG. 9).

In some embodiments, the rotatable arms 214 may be engaged between the sloped surface 236 of the stop block 232, and the engagement features 234 may substantially lock the rotatable arms 214 at a predetermined angle relative to the longitudinal axis 237 of the body 202. For example, the rotatable arms 214 may be locked at an angle between 35° and 90° relative to the longitudinal axis 237 of the body 202 in some embodiments. In at least some embodiments, the angular offset between the rotatable arms 214 and the longitudinal axis 237 may be within a range having lower and upper values that include any of 35°, 45°, 55°, 65°, 70°, 75°, 80°, 85°, 90°, or any value therebetween. For instance, the rotatable arms 214 may be between 45° and 70° from the longitudinal axis 237, between 30° and 45° from the longitudinal axis 237, or between 45° and 90° from the longitudinal axis 237. In other embodiments, the rotatable arms 214 may be less than 35° or more than 90° from the longitudinal axis 237. In at least one embodiment, the predetermined angle may allow more surface area of the rotatable arms 214 to engage the casing material (not shown) than surface area that would be engaged at a 90° predetermined angle with the same cutting diameter.

While the rotatable arms 214 are depicted as being curved at their outer radial edge, it should be understood that the rotatable arms 214 may include any suitable shape. In at least one embodiment, a rotatable arm 214 including a curved portion may distribute loads evenly during operation and may allow the rotatable arm 214 to experience high loads before failure.

Figure 3:
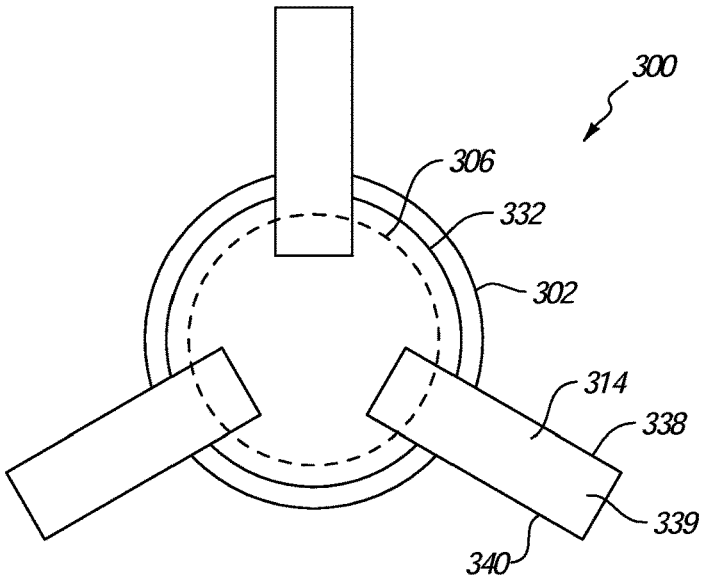
FIG. 3 is a schematic top view of a section milling device having rotatable arms in an extended position, according to some embodiments of the present disclosure.
Figure 4:
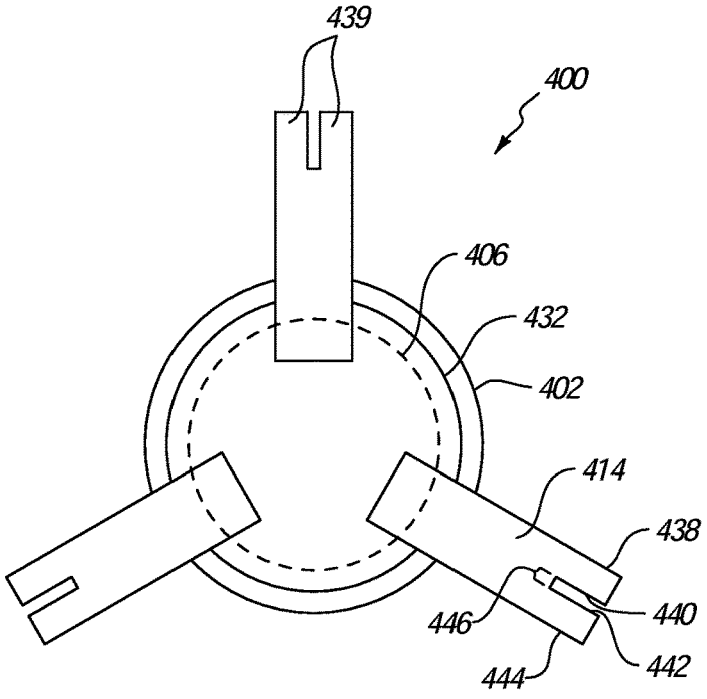
FIG. 4 is a schematic top view of a section milling device having rotatable arms with secondary cutting members, according to some embodiments of the present disclosure.
Figure 5:
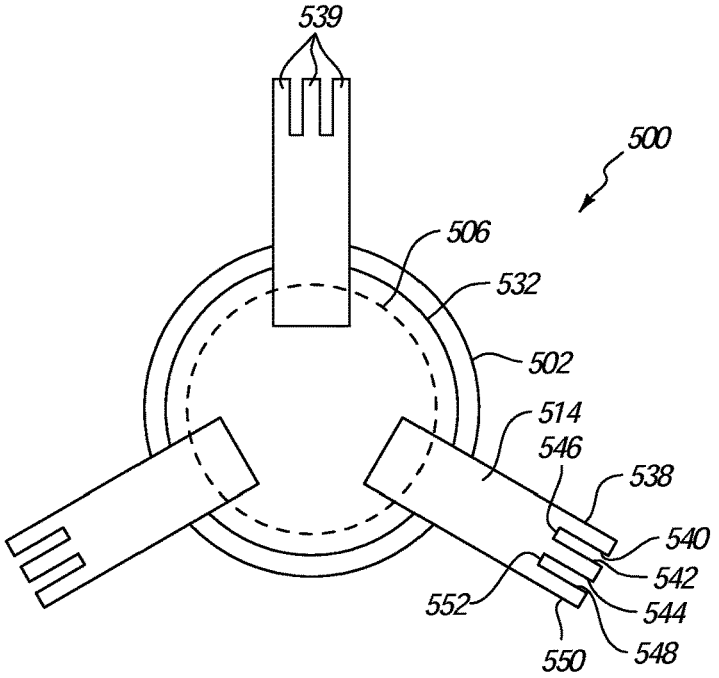
FIG. 5 is a schematic top view of a section milling device having rotatable arms with tertiary cutting members, according to some embodiments of the present disclosure.

FIGS. 3 through 5 schematically illustrate top views of embodiments of a plurality of rotatable arms 314, 414, 514 in accordance with embodiments of the present disclosure. The rotatable arms 314, 414, 514, may be located axially/longitudinally between a stop block 332, 432, 532 and a first piston 306, 406, 506. A body 302, 402, 502 is also depicted for reference to the extension of the rotatable arms 314, 414, 514. Referring to FIG. 3, the rotatable arms 314 may each have a front face 338 and a back face 340 defining a cutting member 339. The rotatable arms 314 may move circumferentially as at least part of the section milling device 300 rotates. It should be understood that "front" and "back" descriptors are relative to the direction of rotation. In the depicted embodiment in FIG. 3, for example, the direction of rotation is counterclockwise. In other embodiments, the direction of rotation may be clockwise.

FIG. 4 depicts another embodiment of a section milling device 400 having a plurality of rotatable arms 414. As illustrated, a periphery of the rotatable arms 414 may each have a pair of cutting members 439 or cutting members formed through bifurcation of the rotatable arms 414. One cutting member 439 may be defined by a front face 438 and a back face 440, while another cutting member 439 may be defined by a secondary front face 442 and a secondary back face 444. The back face 440 and the secondary front face 442 may define a clearing gap 446 therebetween. In at least one embodiment, the clearing gap 446 may increase a removal rate of casing material during operation.

FIG. 5 depicts another embodiment of a section milling device 500 having a plurality of rotatable arms 514. The rotatable arms 514 may each have a set of three cutting members 539 (i.e., the rotatable arm 514 may be trifurcated). One cutting member 539 may be defined by a front face 538 and a back face 540. Another cutting member 539 may be defined by a secondary front face 542 and a secondary back face 544. The back face 540 and the secondary front face 542 may define a clearing gap 546 there between. Yet another cutting member 539 may be defined by a tertiary front face 548 and a tertiary back face 550. The secondary back face 544 and tertiary front face 548 may define a secondary clearing gap 552.

While FIGS. 3 through 5 depict rotatable arms 314, 414, 514 having one, two, or three cutting members 339, 439, 539 respectively, it should be understood that embodiments of a section milling device according to the present disclosure may include any number of cutting members located on each rotatable arm, including a different number of cutting members on one or more of the rotatable arms in a section milling device. For example, a section milling device may have a plurality of rotatable arms with one cutting member on one rotatable arm, two cutting members on another rotatable arm, and three cutting members on yet another rotatable arm.

Figure 6:
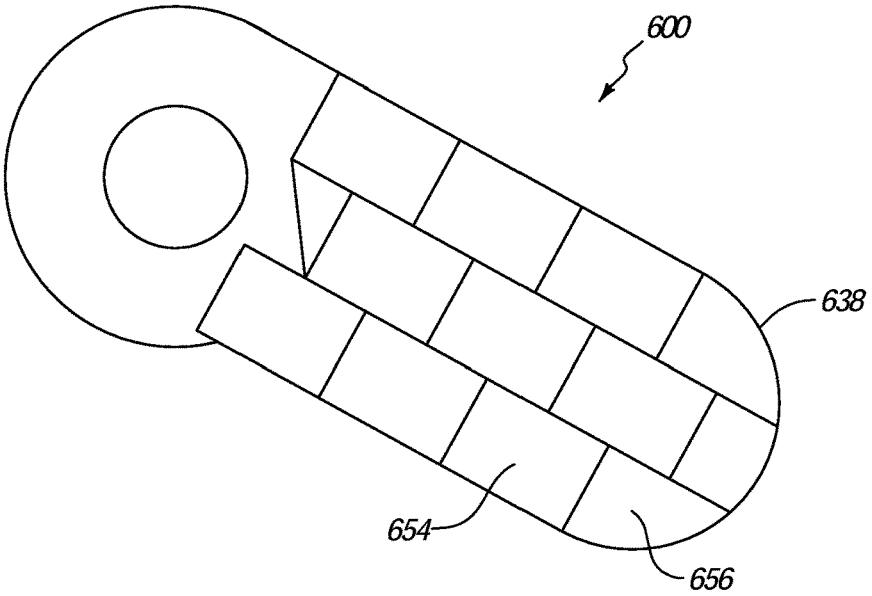
FIG. 6 is a detailed side view of a rotatable arm including a plurality of cutting inserts coupled to a front face of the rotatable arm, according to some embodiments of the present disclosure.

FIG. 6 depicts a side view of a rotatable arm 614. More specifically, FIG. 6 depicts a front face 638 of a rotatable arm 614. The front face 638 of a rotatable arm 614 may include one or more section mill inserts or cutting inserts 654. The one or more cutting inserts 654 may form a cutting surface 656. As depicted in FIG. 6, the one or more cutting inserts 654 may be similar or may vary in shape to accommodate the shape of the cutting surface 656. The cutting inserts 654 may include a superhard material such as tungsten carbide, polycrystalline diamond, cubic boron nitride, other material suitable for cutting steel or other metallic materials, or combinations thereof.

While the cutting inserts 654 are illustrated as being oriented and arranged in rows extending along the length of the rotatable arm 614 (i.e., in a radial direction), it can be understood that the inserts 654 can be orientated differently. For instance, the cutting inserts 654 can be angularly orientated across the rotatable arm 614 transverse to the length of the rotatable arm 614. Various other orientations would be understood by one skilled in the art in view the disclosure herein. For instance, the illustrated cutting inserts 654 are shown in a brickwork type pattern in rows that extend along the length of the rotatable arm 614. In other embodiments, the cutting inserts 654 may be oriented in columns extending perpendicular to the length of the cutting inserts 654. In some embodiments, the cutting inserts 654 may be in both rows and columns (e.g., a checkerboard pattern instead of a brickwork pattern). The cutting inserts 654 may thus be coupled to the rotatable arm 614 in any number of different tiled or other patterns.

Figure 7:
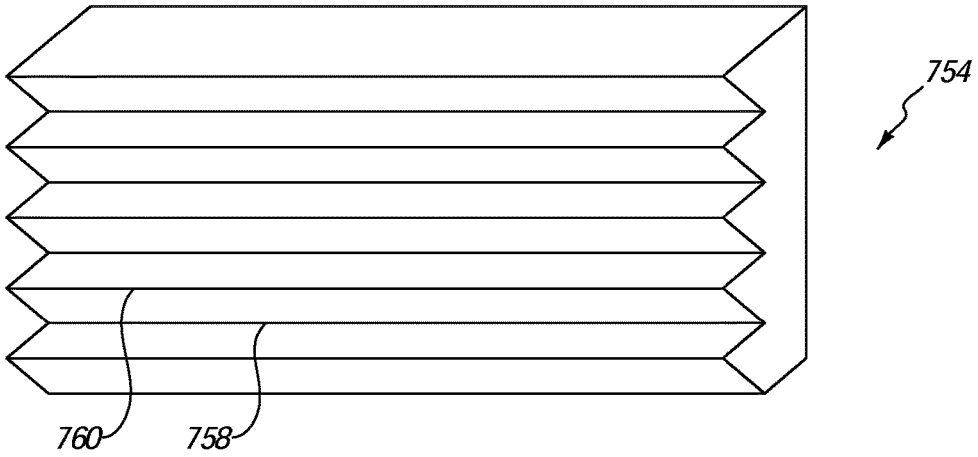
FIG. 7 is a side view of a cutting insert with longitudinal cutting edges parallel to a longitudinal edge of the cutting insert, according to some embodiments of the present disclosure.
Figure 8:
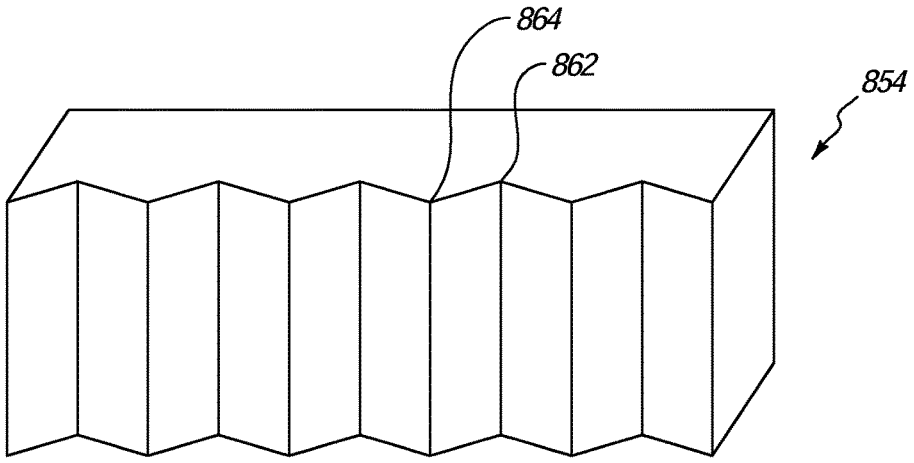
FIG. 8 is a side view of a cutting insert with lateral cutting edges perpendicular to a longitudinal edge of the cutting insert, according to some embodiments of the present disclosure.

FIGS. 7 and 8 depict embodiments of section mill inserts or cutting inserts 754, 854 in accordance with some embodiments of the present disclosure. FIG. 7 depicts a cutting insert 754 including a plurality of longitudinal cutting edges 758 and longitudinal recesses 760 that are substantially parallel to an edge of the insert 754. The longitudinal cutting edges 758 and longitudinal recesses 760 may form symmetrical ridges (i.e., each longitudinal recess 760 is equidistant from each adjacent longitudinal cutting edge 758) or asymmetrical ridges (i.e., each longitudinal recess 760 is closer to one adjacent longitudinal cutting edge 758 than another). The number of longitudinal cutting edges 758 and longitudinal recesses 760 may vary. For instance, there may be between one and ten longitudinal cutting edges 758 and/or longitudinal recesses.

FIG. 8 depicts a section mill insert or cutting insert 854 including a plurality of lateral cutting edges 864 and lateral recesses 862. The lateral cutting edges 864 and lateral recesses 862 may form symmetrical ridges (i.e., each lateral recess 862 is equidistant from each adjacent lateral cutting edge 864) or asymmetrical ridges (i.e., each lateral recess 862 is closer to one adjacent lateral cutting edge 864 than another.) As is also depicted in FIG. 8, the lateral cutting edges 864 and lateral recesses 862 may form an angle with an edge of the insert 854. In at least one embodiment, lateral cutting edges 864 and lateral recesses 862 that form an angle with an edge of the insert 854 may change the removal rate of casing material. The cutting inserts 754, 854 of FIGS. 7 and 8 are merely illustrative. In other embodiments, for instance, the cutting inserts may have other shapes (e.g., circular, triangular, etc.), may have concentric, circular or elliptical ridges, or the like. Regardless of the particular shape or configuration of the cutting inserts, the cutting inserts may be formed integrally with a blade, arm, or other cutting tool of a milling tool. In other embodiments, the cutting inserts may be formed separately and coupled to the cutting tool (e.g., by welding, brazing, by using mechanical fasteners, etc.). The cutting inserts 754, 854 of FIGS. 7 and 8 may further be configured for use in a face milling operation. In such operation, the cutting edges 758, 864 may cut casing while rotating and while moving longitudinally along the casing within a wellbore.

Figure 9:
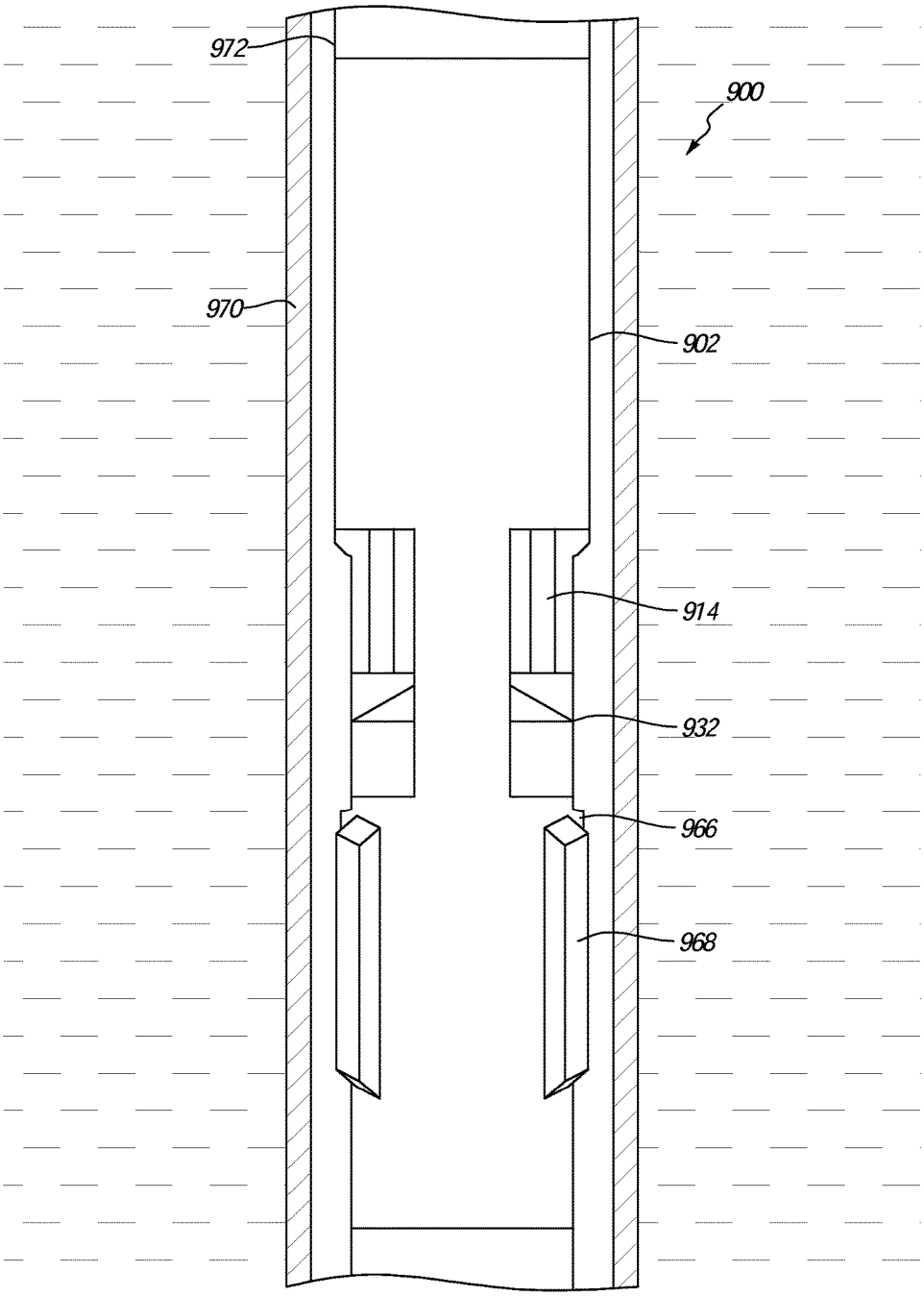
FIG. 9 is a side view of section milling device with an expandable stabilizer inside a casing string, according to some embodiments of the present disclosure.

FIG. 9 depicts another embodiment of a section milling device 900. In this particular embodiment, the section milling device 900 may include an expandable stabilizer 966 that can aid with centering and/or stabilizing the section milling device 900 within the casing string. The expandable stabilizer 966 may include one or more expandable stabilizer members 968 (e.g., arms) that are operatively associated with the body 902 and are expandable (e.g., hydraulically or mechanically actuated). For example, the expandable stabilizer members 968 may be selectively expandable via pressurization of a drilling fluid or other hydraulic fluid provided to expandable stabilizer 966. The drilling fluid or other hydraulic fluid may be provided to the expandable stabilizer 966 through a drill string, additional downhole tools or other fluid conduits. The expandable stabilizer members 968 and body 902 may have an analogous ratio to the expansion ratio of the section milling device 900. For example, the expandable stabilizer members 968 may expand to define a diameter that is greater than a diameter of the body 902. The ratio of a diameter of the maximum diameter of the expandable stabilizer members 968 and a diameter of the body 902 may define a stabilizer ratio. In some embodiments, the stabilizer ratio may be between 1.1 and 1.9. In other embodiments, the stabilizer ratio may be less than the expansion ratio. In further embodiments, the stabilizer ratio may be less than 1.75. In yet other embodiments, the stabilizer ratio may be less than 1.4.

The one or more expandable stabilizer members 968 may be expanded against the casing string 970. In at least one embodiment, one or more expandable stabilizer members 968 may reduce movement of the section milling device relative the casing string 970 during milling. In at least another embodiment, one or more expandable stabilizer members 968 may assist in centering the section milling device relative the casing string 970 during milling (i.e., milling in a lateral borehole). The section milling device 900 may be connected to additional tools including an additional section milling device 972 as part of the same bottomhole assembly. The additional section milling device 972 may have a different expansion ratio than the section milling device 900. Tripping multiple section milling devices 900, 972 with different expansion ratios into a wellbore on a single drill string may allow multiple diameter of casing string 970 to be milled in a single trip. Thus, in a dual-casing or other similar wellbore, the additional section milling device 972 may be used to mill an inner casing string and the section milling device 900 may be used to mill the outer casing string (or vice versa).

Single trip operation may be desirable in some embodiments as each additional trip into a wellbore may be time-consuming and costly. Further, some wellbores may include an upper casing (i.e., portion of the wellbore closer to the surface) that is smaller than the lower casing (i.e., portion of the wellbore closer to the intended location of the cement plug). Also, in dual-string milling applications where the inner casing string is milled first, the remaining inner string present above the zone of interest may present a wellbore restriction. Embodiments of the present disclosure may be used to minimize or prevent difficulties with larger diameter milling blades when the wellbore itself provides a constriction that allows relatively small diameter tool strings to be placed in the larger diameter, lower portion of the casing. Use of an expandable stabilizer 966 may further be used to maintain a casing string substantially concentric after milling, so that the casing string does not significantly shift to one side after milling.

The articles "a," "an," and "the" are intended to mean that there are one or more of the elements in the preceding descriptions. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features. Any numbers, percentages, ratios, or other values stated herein are intended to include that value as well as other values that are "about" or "approximately" the stated value, as would be appreciated by one of ordinary skill in the art encompassed by embodiments of the present disclosure. A stated value should therefore be interpreted broadly enough to encompass values that are at least close enough to the stated value to perform a desired function or achieve a desired result. The stated values include at least the variation to be expected in a suitable manufacturing or production process. Such values, as well as any other uses of the terms "approximately," "about," and "substantially" may include values or amounts that are within 5%, within 1%, within 0.1%, or within 0.01% of a stated value.

A person having ordinary skill in the art should realize in view of the present disclosure that equivalent constructions do not depart from the spirit and scope of the present disclosure, and that various changes, substitutions, and alterations may be made to embodiments disclosed herein without departing from the spirit and scope of the present disclosure. Equivalent constructions, including functional "means-plus-function" clauses are intended to cover the structures described herein as performing the recited function, including both structural equivalents that operate in the same manner, and equivalent structures that provide the same function. It is the express intention of the applicant not to invoke means-plus-function or other functional claiming for any claim except for those in which the words 'means for' appear together with an associated function. Each addition, deletion, and modification to the embodiments that falls within the meaning and scope of the claims is to be embraced by the claims.

It should be understood that any directions or reference frames in the preceding description are merely relative directions or movements. For example, any references to "up" and "down" or "above" or "below" are merely descriptive of the relative position or movement of the related elements. It should be understood that "upward" and "downward" are relative directions. As used herein, "upward" should be understood to refer to an uphole direction and/or closer to the surface, rig, operator, or the like in the case of a lateral borehole. "Downward" should be understood to refer to a downhole direction and/or further from the surface, rig, operator, or the like in the case of a lateral borehole.

The present disclosure may be embodied in other specific forms without departing from its spirit or characteristics. The described embodiments are to be considered as illustrative and not restrictive. The scope of the disclosure is, therefore, indicated by the appended claims rather than by the foregoing description. Changes that come within the meaning and range of equivalency of the claims are to be embraced within their scope.

What is claimed is:

1. A device, comprising:

a tubular body;

a first piston within the tubular body;

a plurality of openings extending radially through the tubular body;

a plurality of rotatable arms each having a cutting member defined by a front face and a back face, each rotatable arm rotatably coupled to the first piston such that an arm connection point is located radially within an inner surface of the tubular body, and each rotatable arm configured to be rotated between a retracted position and an extended position; and a cutting surface on the front face of the cutting member, the cutting surface including a at least one cutting insert coupled thereto.

2. The device of claim 1, each of the plurality of rotatable arms further including a secondary cutting member including a secondary front face parallel to and proximate the back face, the secondary front face and the back face defining a clearing gap therebetween.

3. The device of claim 2, each of the plurality of rotatable arms further includes a tertiary front face parallel to and proximate a secondary back face, the secondary front face and the back face defining a secondary clearing gap therebetween.

4. The device of claim 1, further comprising:

one or more expandable stabilizer members operatively associated with the tubular body and configured to have an expanded position having a stabilizer diameter greater than an outer diameter of the tubular body.

5. The device of claim 1, further comprising:

an expandable an underreamer or section mill coupled to the tubular body and configured to be expanded to remove cement.

6. The device of claim 1, further comprising:

a first fluid chamber, the first piston being associated with the first fluid chamber;

a second fluid chamber;

a second piston associated with the second fluid chamber; and a stop block associated with the second fluid chamber and having an engaged position and a disengaged position, the stop block having a sloped surface configured to engage directly with the plurality of rotatable arms in the extended position when in the engaged position.

7. The device of claim 6, further comprising:

a fluid passage between the first fluid chamber and second fluid chamber and configured to provide fluid communication between the first fluid chamber and second fluid chamber.

8. A system for removal of casing in a downhole environment, the device comprising:

a section milling device including:

a tubular body;

a first piston within the tubular body, the first piston being movable between a pressurized position and an unpressurized position;

a plurality of openings extending radially through the tubular body;

at least three rotatable arms each having a front face and a back face, each rotatable arm coupled to the first piston and configured to rotate between a retracted position and an extended position, wherein at the pressurized position of the first piston, an arm connection point is longitudinally aligned with at least one of the plurality of openings; and a cutting surface on each front face and adjacent a first end portion of each of the rotatable arms, the cutting surface including a plurality of cutting inserts coupled thereto in a tiled pattern; and one or more expandable stabilizer members operatively associated with the section milling device and configured to apply a radially outward force on a casing.

9. The system of claim 8, each of the at least three rotatable arms further including a secondary cutting member including a secondary front face parallel to and proximate the back face, the secondary front face and the back face defining a clearing gap therebetween.

10. The system of claim 8, wherein at the unpressurized position of the first piston, the arm connection point is located longitudinally adjacent an inner surface of the tubular body.

11. The system of claim 8, the plurality of cutting inserts include at least one cutting insert with a plurality of cutting edges oriented to be one or more of the following:

parallel to an edge of the at least one cutting insert;

parallel to a longitudinal axis of the tubular body when the at least three rotatable arms are in the retracted position;

at a non-zero angle with the longitudinal axis of the tubular body when the at least three rotatable arms are in the extended position;

perpendicular to the longitudinal axis of the tubular body when the at least three rotatable arms are in the extended position;

linearly;

circularly; or elliptically.

12. The system of claim 8, an expansion ratio of the at least three rotatable arms relative to the tubular body being greater than 1.35:1.

13. The system of claim 8, further comprising:

a first fluid chamber;

a second fluid chamber in fluid communication with the first fluid chamber;

a fluid outlet in fluid communication with the second fluid chamber;

a first piston associated with the first fluid chamber and rotatably connected to a second end of each of the rotatable arms at an arm connection point;

a second piston associated with the second fluid chamber; and a stop block associated with the second fluid chamber and having an engaged position and a disengaged position, the stop block having a sloped surface configured to engage with the rotatable arms in the extended position when in the engaged position.

14. A method, comprising:

tripping a section milling device into a cased wellbore;

expanding an expandable stabilizer member coupled to the section milling device;

moving a plurality of rotatable arms of the section milling device to an extended position such that the plurality of rotatable arms are adjacent casing of the cased wellbore and define a cutting diameter greater than 1.2 times a body diameter of the section milling device, wherein moving the plurality of rotatable arms includes:

pressurizing the section milling device with drilling fluid and moving a piston within a body of the section milling device to a pressurized position; and rotating the rotatable arms about an arm connection located on the piston;

rotating the plurality of rotatable arms relative to a longitudinal axis of the casing; and while rotating the plurality of rotatable arms, cutting the casing using a cutting surface on the rotatable arms, the cutting surface being configured to cut the casing by face milling.

15. The method of claim 14, further comprising flushing cuttings from the cutting surface using drilling fluid.

16. The method of claim 14, wherein the cutting diameter is greater than 1.4 times the body diameter.

17. The method of claim 16, wherein the section milling device includes first and second section mills, the first section mill being configured to mill an inner casing and the second section mill being configured to use the plurality of rotatable arms to mill an outer casing.

* * * * *